United States Patent [19]

Jordan et al.

[11] 3,977,341

[45] Aug. 31, 1976

[54] EASY OPENING CONTAINER COMPONENT

[75] Inventors: Charles L. Jordan, Pittsburgh; Richard C. Speer, Lower Burrell, both of Pa.

[73] Assignee: Aluminum Company of America, Pittsburgh, Pa.

[22] Filed: Mar. 13, 1975

[21] Appl. No.: 558,143

Related U.S. Application Data

[62] Division of Ser. No. 477,074, June 6, 1974, Pat. No. 3,902,626.

[52] U.S. Cl. ..... 113/15 A; 113/121 C

[51] Int. Cl.[2] ..... B21D 51/38

[58] Field of Search ..... 113/15 A, 121 C; 220/265, 268, 270

[56] References Cited

UNITED STATES PATENTS

| | | | |
|---|---|---|---|
| 2,047,830 | 7/1936 | Lofts | 113/15 A |
| 3,227,304 | 1/1966 | Asbury | 220/268 |
| 3,576,272 | 4/1971 | Colby | 220/270 |
| 3,610,463 | 10/1971 | Brown et al. | 220/270 |
| 3,886,881 | 6/1975 | Pearce et al. | 113/121 C |

FOREIGN PATENTS OR APPLICATIONS

| | | | |
|---|---|---|---|
| 44,198 | 2/1925 | Norway | 113/15 A |

*Primary Examiner*—Lowell A. Larson
*Attorney, Agent, or Firm*—David W. Brownlee

[57] ABSTRACT

An easy opening container component and a method and tools for forming the same are provided in which the container component includes a substantially rigid inwardly displaceable opening panel including a V-shaped weakening indentation therearound in the public or exterior surface of the component providing a fracturable web at the root of the indentation adapted to be fractured by inwardly directed pressure digitally applied against an integral outwardly projecting deflectable portion of the container component around the opening panel. The V-shaped indentation may be formed in the exterior surface of the container component while the opposite surface lies against a rounded anvil which forms an inwardly concave undersurface on the non-public surface of the container component, and may be formed in sheet metal without destroying the integrity of a protective coating on the interior surface thereof.

9 Claims, 7 Drawing Figures

EASY OPENING CONTAINER COMPONENT

This is a division of application Ser. No. 477,074, filed June 6, 1974, now U.S. Pat. No. 3,902,626.

BACKGROUND OF THE INVENTION

1. Field of the Invention

This invention relates to container components and more particularly to an improved method and apparatus for forming and construction of a digitally openable container component such as an end closure that can be formed from sheet metal having a protective coating on the surface thereof which is to be the non-public surface of the closure without adversely affecting the integrity of the coating during the forming operation. The container component which is thus formed can be sealed on containers for soda pop or the like which may be corrosive to metal without repair coating the non-public surface of the component.

2. Description of the Prior Art

Many millions of the so-called easy opening can ends are used each year for cans of soda pop and other beverages. Most of these easy opening can ends are of the pull tab type with an integral rivet connecting the tab to a severable tear strip. In recent years, these container ends have been criticized because of their having a removable tear strip portion, and the propensity of consumers to indiscriminately dispose of tab and tear strip immediately following their separation from the container. In part, the problems attendant such indiscriminate tab disposition has resulted in the actual or contemplated banning of such closures in certain jurisdictions. An easy opening container end is therefore desired which has no severable tab and tear strip to be indiscriminately discarded. Preferably, such tabless container ends should be suited for use with all kinds of beverages and should be adapted to be formed from precoated sheet without the need for repair coating the formed container closure.

The prior art and notably the patented art, is replete with many suggested expedients for achieving the long desired objective of simplified can opening, including several suggested expedients for can closures that can be digitally opened, i.e., manually opened without the use of auxiliary tools or the like. Included in such expedients are the use of container walls and end closures which include weakening lines or score lines defining tear strips or panels which can either be depressed into or pried out of a container to form either a vent or a pouring opening therein. Closures of this type are exemplarily disclosed in a number of U.S. Pat. Nos. including Newman 1,805,003, Fried 2,176,878, Asbury 3,227,304, Asbury 3,246,791, Asbury 3,355,058, Klein et al. 3,334,775, Foss et al 3,401,436, Punte 2,187,433, Punte 2,289,452, Punte 2,312,358, Punte 2,312,359, Fink 2,119,533, Punte 2,120,186, Geiger 3,362,569 and Klein 3,779,417. Such end closures have sometimes required the use of rigid tools, such as a coin or a fork, to rupture the score line around the removable panel in order to form an opening in the end closure. Several of such end closures have included embossments in the removable portion to facilitate opening of the removable portion by pressing or prying against such embossments.

Metal container ends for easy opening cans for corrosive contents such as carbonated soft drinks, fruit juices and the like usually have a protective coating on the interior or non-public surface of the container end to protect the metal from the container contents. When the container ends are formed from coated sheet, forming the score lines or weakening lines in container ends sometimes fractures or breaks the coating and expose bare metal to the container contents which can corrode the metal and cause perforations through the container end closure. Easy opening container ends have therefore sometimes been repair coated to insure that no bare metal is exposed after the weakening line has been formed. It is also known to provide improved coating systems which resist fracture or cracking of the coating during the forming operation as is disclosed in U.S. Pat. No. 3,632,461. Methods and tools are also known for forming weakening lines or score lines in can ends without adversely affecting the integrity of the protective coating on the ends as is disclosed in a number of U.S. Pat. Nos. including Schrecker 3,688,718, Franek et al. 3,687,099 and Cookson 3,698,590 among others. However, all of these methods have been adapted for forming score lines in easy opening container walls which have pull tabs or the like attached to the severable tear strips to facilitate severance of the score lines. The methods and apparatus disclosed in such patents are not adapted for forming tabless container components in which the score lines or weakening lines may be severed by digitally applied pressure. Other prior art disclosures of interest relative to methods and tools for forming weakening or score lines are contained in the following U.S. Pat. Nos. Morfoot 619,259, Kennedy et al. 3,543,961, Franek et al. 3,638,825, Fraze 3,291,336, Stuchbery 3,359,773 and Saunders 3,507,418.

SUMMARY OF THE INVENTION

This invention may be summarized as providing an improved tabless easy opening container device and a method and apparatus for forming the same. The tabless easy opening device includes a substantially rigid inwardly displaceable opening panel bounded in substantial part by a substantially V-shaped indentation in the public surface of the component opposing an inwardly concave non-public surface with a fracturable web of metal therebetween defining a locus of separation of the opening panel from the adjacent portion of the container component. An integral outwardly projecting deflectable portion is provided in the container component around the opening panel adjacent to the fracturable web, and is adapted to be depressed in response to digitally applied inwardly directed pressure to produce a relative displacement of the metal on opposite sides of the fracturable web to strain the web and initiate fracture thereof to permit inward displacement of a separating opening panel. The fracturable web in the container component is disposed outwardly of the general plane of the container component around the deflectable portion so that the fracturable web will be displaced toward such general plane when the deflectable portion is inwardly pressed.

In accordance with this invention, opening panels can be formed in a sheet metal container component by introducing the component between a first die member having a V-shaped indentor thereon and a second die member having a generally rounded corner opposing the indentor on the first die member and with an auxiliary die means disposed on the same side of the sheet as the first die member with a base surface on it facing the second die member and laterally spaced therefrom.

The first die member and the auxiliary die means are moved against the sheet of metal supported on the second die member to engage the sheet and laterally displace portions of it to form a V-shaped indentation in the outer surface of the sheet and a rounded contour in the inner surface of the sheet with the fracturable web therebetween. The lineal displacement of the auxiliary die means forms a deflectable portion by the conjoint action of the base surface on the die means and the metal supporting surface on the second die member.

Among the advantages of the subject invention is the provision of a digitally openable metal container closure construction which is adapted to be formed from coated container sheet without post repair coating the formed closure.

Another advantage includes the provision of a highly reliable end closure of minimum metal content that can be fabricated with a minimal number of fabricating steps at extremely high production rates with simple tooling. Further, advantages include the provision of an end closure that can be opened by application of modest amounts of digitally applied pressure without the use of auxiliary tools and the overcoming of ecology based objections to present day pull tab easy opening devices with severable tear strips.

An object of this invention is the provision of an improved method and apparatus for forming and construction of a digitally openable container end closure that can be formed from coated container sheet without the need for repair coating.

Another object of the invention is to provide a tabless container wall which can be opened with modest amounts of pressure with the fingers.

A further object of the invention is to provide a tabless container opening device having at least one substantially rigid opening panel defined by a V-shaped indentation in the public surface of the container wall and an inwardly concave contour of the non-public surface of the container component with a protective coating thereover, the integrity of which has not been destroyed by the forming operation.

The above and other objects and advantages of this invention will be more fully understood and appreciated with reference to the following description and the drawings appended hereto.

DESCRIPTION OF A PREFERRED EMBODIMENT

In order to facilitate understanding of the subject invention and in the interest of clarity, the terms inwardly and outwardly will be herein employed to delineate directions relative to the interior and exterior respectively of a cylindrical container having an end closure mounted on the end thereof.

Figure 1:
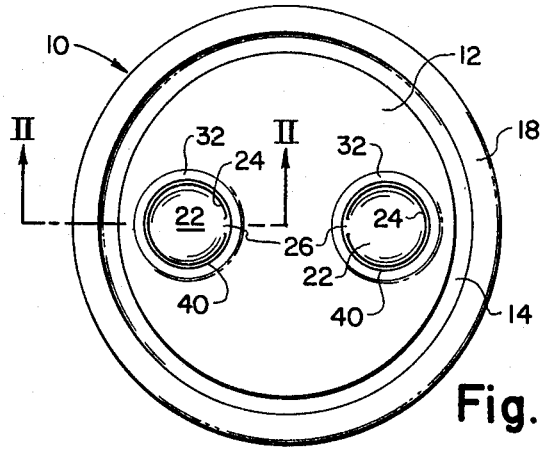
FIG. 1 is a plan view of a can end of the invention.
Figure 2:
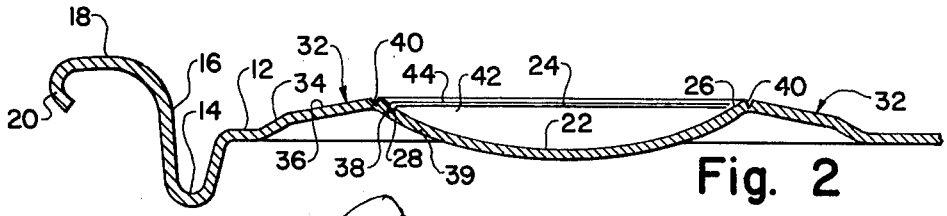
FIG. 2 is an enlarged cross section through a portion of the can end of FIG. 1 taken along lines 2—2.

Referring to FIGS. 1 and 2, a metal container component or can end 10 is shown which includes a substantially planar central panel or wall 12, a peripheral groove 14 around the panel, an upstanding wall 16 outwardly of the groove, a peripheral flange 18 extending outwardly from the top of the upstanding wall and a curled edge 20 on the outer end of the flange. Such general construction of a peripherally chimed can end is typical of can ends which are adapted to be sealed on container bodies by conventional double seaming operations. Can end 10 may be formed from sheet metal such as work hardened aluminum alloy sheet material, and is preferably formed from aluminum alloy sheet material which is at least three quarter hard temper or an extra hard temper alloy which has been partially annealed as a result of heating it to cure a protective coating thereon. The can end 10 may have a protective coating or film, not shown, on its interior or non-public surface to protect it from corrosion by liquid contents such as soda, pop or fruit juice. The protective coating may be any of a variety of well known coatings for such purpose and may be applied in quantities, for example, of approximately 10 to 12 milligrams per square inch, although not limited thereto. Vinyl coatings have been found to function well on container components of this invention.

A preferred embodiment of a can end 10 of this invention includes at least one, and preferably two, substantially rigid inwardly displaceable circular opening panels 22 of equal diameter defined by weakening lines 24 in the central wall 12. Panels 22 are designed to be opened by displacing them into a container on which can end 10 is sealed to form a pouring opening and a vent opening in the can end. A hinge portion 26 may be provided for each opening panel 22 by leaving an essentially unweakened section of metal between the ends of the weakening line to prevent complete separation of the opening panel from the container end and thereby prevent the opening panel 22 from dropping into a container after inwardly displacement of the opening panel.

In accordance with this invention, each weakening line 24 preferably comprises a substantially V-shaped indentation 28 in the exterior or public surface of the can end 10 providing a fracturable web of residual metal 38 at the base or root of the V toward the non-public surface of the can end. The V-shaped indentation may have approximately a 75° included angle between its sides, although the invention is not limited to such an angle. For example, it is believed that an angle of approximately 45° to 90° or more degrees between the sides of the V-shaped indentation will also work satisfactorily. The apex of the V-shaped indentation is relatively sharp or pointed as a result of the shape of the tool or indentor which is used to form the indentation. The undersurface or non-public surface 39 of the container component underlying the V-shaped indentation is preferably of inwardly concave shape which is also a result of the shape of the tools which are employed in forming of the weakening line. The importance of the V-shaped indentation 28 and inwardly concave undersurface 39 of the container component will be more fully understood and appreciated when the method and tools for forming such indentation and inwardly concave metal surface are described.

The fracturable web of residual metal 38 between the apex of the V-shaped indentation 28 and the undersurface 39 of the container component is preferably relatively thin to facilitate fracture thereof to inwardly displace a separated opening panel. For example, such fracturable web 38 may have a thickness extending from the apex of the V-shaped indentation to the undersurface of the container component of approximately 0.002 inch to 0.004 inch.

Can end 10 of this invention further includes an integral outwardly projecting deflectable portion 32 around each opening panel 22 extending from the wall 12 to the weakening line 24 in surrounding relation with each opening panel 22. In a preferred embodiment of this invention, each deflectable portion 32 includes an annular outer wall portion 34 and an annular upper wall portion 36. The outer wall portion 34 extends at an angle from the generally planar wall 12 to the upper wall portion 36 which extends from the outer wall 34 to the fracturable web 38. The upper wall portion 36 may be disposed at a slight angle to the plane of the planar wall 12 such as approximately a 6° angle, but is not limited thereto. For example, the upper wall portion 36 may be parallel with planar wall 12 or may be disposed at an angle of up to approximately 15° to such wall. The deflectable portion 32, and in particular, the upper wall portion 36 thereof, is adapted to be responsive to inwardly direct pressure applied digitally thereagainst to effect a relative displacement of metal on opposite sides of the fracturable web 38 to strain the web and initiate fracture thereof to permit inward displacement of a separated opening panel as will be explained.

The can end 10 further preferably includes a coined line or zone of coining 40 in the exterior surface of the can end in the deflectable portion 32 adjacent the fracturable web 38 around the opening panel 22. The coined line 40 is substantially parallel with the fracturable web 38 and is spaced from such web a distance of approximately one to three times the thickness of the sheet metal from which the can end is formed. Forming of the coined line 40 in the can end facilitates forming the V-shaped indentation 28 in sheet metal having thicknesses which vary within commercially acceptable tolerances.

Figure 5:
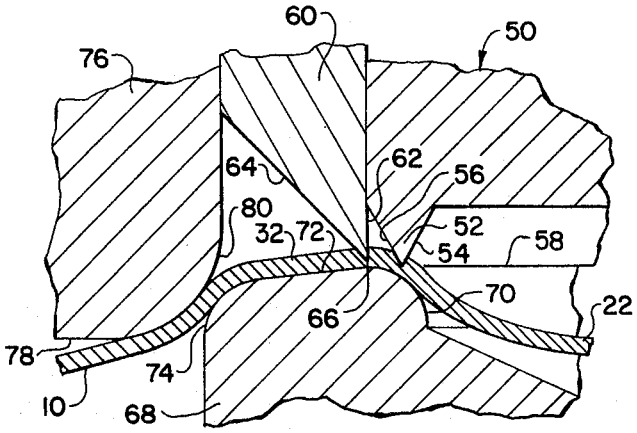
FIG. 5 is an enlarged cross-sectional view showing formation of a V-shaped, indentation, coined line and deflectable portion in a container component.

As stated above, each opening panel 22 is preferably substantially rigid. It is believed that a substantially rigid opening panel 22 facilitates initiation of fracture of the fracturable web 38 in the weakening line 24 around each opening panel. The rigidity of each opening panel 22 may, for example, be provided by a concavo-convex shape thereof as is shown in FIGS. 2 and 5, and may be projected either inwardly or outwardly, although preferably inwardly as is illustrated.

The outer marginal edge or rim 42 of the inwardly convex opening panel 22 is outwardly and upwardly curved and is connected to the inwardly and downwardly curved inner marginal edge or lip 44 of the deflectable portion 22 through the fracturable web 38. The undersurfaces of such rim and lip form an inwardly concave surface 39 underlying the fracturable web 38. The V-shaped indentation 28 is preferably formed inwardly of or below the outer most projection of the deflectable portion so the apex of the indentation is in substantial alignment, or is substantially coplanar, with at least a portion of the undersurface of the deflectable portion 32, and so the outer edge of the opening panel at least partially underlies the inner edge portion of the lip of the deflectable portion around the opening panel to restrain the opening panel against being forced outwardly from the can end by pressure in a container on which the can end is sealed. In other words, such location of the V-shaped indentation provides an overlapping relationship of the metal in the lip of the deflectable portion with the metal in the rim of the opening panel to prevent blow out of the opening panel. This overlapping relationship of the metal across the weakening line also results in inward displacement of an opening panel which is larger than the opening or aperture which is formed in the can end as a result of inward displacement of the opening panel. A separated opening panel can therefore not be inadvertently poured or dispensed from the container.

Figure 3:
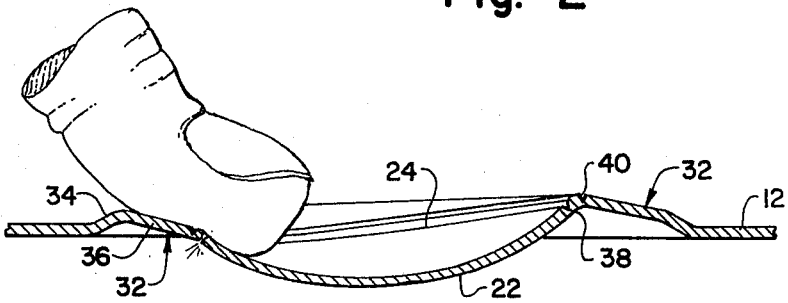
FIG. 3 is an enlarged cross sectional view similar to FIG. 2, except at approximately a 90° thereto, and further illustrating initiation of severance of the fracturable web around the opening panel.

FIG. 3 illustrates initiation of fracture of the web 38 around an opening panel 22. This can be effected by applying inwardly directed digital pressure against the can end in the area of the fracturable web 38 to inwardly deflect a portion of the deflectable portion 32 and opening panel 22. Such inward displacement of the deflectable portion and opening panel produces relative displacement of metal on opposite sides of the fracturable web to strain the web and initiate fracture thereof to permit inward displacement of a separated opening panel. Digital pressure applied against the container end overlying the fracturable web 38 will cause localized bending of the deflectable portion 32 in the area of pressure application while other sections of the deflectable portion and the substantially rigid opening panel will essentially maintain their original shape. This strains the fracturable web as a result of the relative metal displacement on opposite sides of the web to initiate fracture thereof as is illustrated in FIG. 3. Such fracture may initially occur at the point of digital pressure but frequently appears to occur at a location spaced approximately 90° around the opening panel from the point of pressure application.

It is believed that the shape of the deflectable portion 32 illustrated in FIGS. 2 and 3 may be beneficial to relatively easy initiation of fracture of the fracturable web when the can end 10 is sealed on a container having relatively high internal pressures such as approximately 60 to 100 or more pounds per square inch. The combination of the outer wall portion 32 and upper wall portion 36 may facilitate inward displacement of a relatively small area of the container component which will be less resisted by relatively high internal pressures in the container than would a large area. Digital pressure applied against the container component at or near the weakening line 24 will depress a portion of the deflectable portion by hinging or bending the upper wall portion 36 downwardly about the corner between the upper wall portion and the outer wall portion 34. The portion of the upper wall portion 36 which is depressed is relatively small so a minimum of force is required to depress it against the internal pressure to initiate fracture of the fracturable web.

Figure 4:
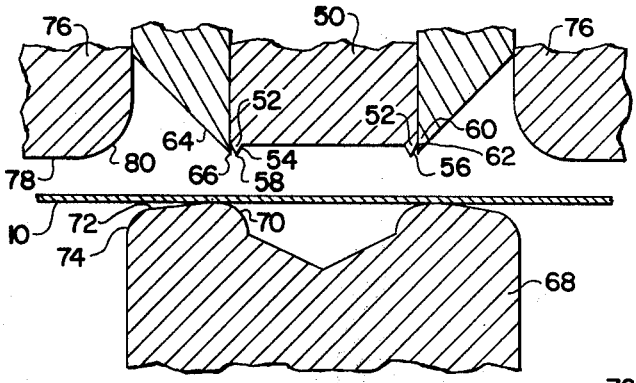
FIG. 4 is an enlarged fragmentary cross sectional view showing exemplary tools which may be used in forming a container component of this invention.

FIG. 4 illustrates exemplary tools for forming a container component in accordance with this invention. Such tools include a first die member 50 having an annular indentor 52 on it with a first substantially planar metal working surface 54 and a second and angularly disposed substantially planar metal working surface 56 defining a corner 58 with the first surface 54 at the locus of intersection therebetween. The solid portion of the indentor 52 between first and second surfaces 54 and 56 has an included angle of approximately 75°, although other angles such as approximately 45° to 90° may also be used. The corner 58 preferably has a relatively sharp projecting edge thereon as may be formed by merely deburring the edge after surfaces 54 and 56 have been formed by grinding or other methods. The tools 50 further include a coining rib 60, either as an integral part of the first die member 50 or as a separate member, with the coining rib having a substantially planar vertical surface 62 and a second substantially planar and angularly disposed surface 64 defining a corner 66 at the locus of intersection with first surface 62. Corner 66 is preferably rounded as with a radius of approximately 0.001 inch. The included angle of the solid portion of the coining rib between surfaces 62 and 64 may, for example, be approximately 45°.

A second die member or anvil 68 is provided which has a metal supporting surface comprising a first rounded corner 70 generally opposing the indentor 52 on the first die member 50, a generally planar surface portion 72 facing upwardly and disposed at a slight angle of approximately 6° to horizontal, and a second rounded corner 74 laterally spaced from the first rounded corner 70 by the planar surface 72. The first rounded corner 70 has a radius of curvature, for example, of approximately 0.020 inch, and the second rounded corner has a radius, for example, of approximately 0.030 inch. Such radii begin from points of tangency with surface 72 and curve downwardly away from such surface.

The tools further include an auxiliary die means 76 with a base surface 78 and a rounded corner 80 thereon which may be generally on the opposite side of the container wall from the second rounded corner 74 on the second die member 68, or may be laterally spaced from such rounded corner 74. The rounded corner surfaces 80 and 74 are adapted to cooperate in the formation of a deflectable portion in the container wall. They may also coin and/or thin the metal in container component 10 when they are closed. Such coining may facilitate forming a deflectable portion in the container component and may also facilitate inward displacement of such a deflectable portion.

The first die member 50, coining rib 60 and auxiliary die means 76 are adapted to be lineally displaced toward the second die member 68 to selectively move the first and second surfaces 54 and 56 of the first die member into cooperative proximity with the metal supporting surface, and in particular the first rounded corner 70 of the second die member to engage a sheet metal container wall or can end 10 therebetween and laterally displace portions of the sheet metal as the corner 58 on the first die member penetrates the sheet to form a weakening line which has a fracturable web of residual metal therein as is illustrated in FIG. 5. The die travel of the first die member is stopped when the corner 58 of indentor 52 has penetrated the sheet to within approximately 0.002 to 0.004 inch of the supporting surface of the second die member to leave a fracturable web of residual metal of like thickness. In the closed position of the dies, the apex of the corner 58 on the first die member 50 is in substantial alignment with the surface 72 on the second die member 68.

The first die member 50 and second die member 68 are preferably designed and dimensioned with the annular indentor 52 having a diameter as measured at corner 58 which is smaller than the diameter of the second die member as measured at the point of tangency between corner 70 and surface 72. For example, such diameters of the first and second die members at such locations may be approximately 0.502 and 0.512 inch respectively for forming an opening panel which is approximately one-half inch in diameter. Accordingly, in lineal displacement of the first die member toward the second die member, the corner 58 of the indentor 52 will form a V-shaped indentation 28 in the container component 10 against the support of the rounded corner 70 on the second die member. This produces an inwardly concave undersurface in the container component under the V-shaped indentation 28 and fracturable web 38. It is believed that the rounded corner 70 distributes the stresses in the metal and the interior coating thereon during the forming process and effectively eliminates fracture of the metal and protective coating. The V-shape and sharp corner 58 on indentor 52 also help to avoid damage to the coating because the metal is effectively cut by such indentor with a minimum of stress produced in the metal and coating under the indentor. Minimizing the stresses in the metal and coating minimizes the possibility of failure of the metal and coating thereon.

The coining rib 60 engages the sheet metal container component 10 and coins it along a zone adjacent to the fracturable web 38 to facilitate forming the weakening line in sheet metal having varying thicknesses within commercially accepted limits. Movement of the auxiliary die means 76 toward the second die member 68 forms a deflectable portion in the sheet metal container wall by the conjoint action of the auxiliary die member and the metal supporting surfaces 72 and 74 on the second die member. The travel of the auxiliary die means is stopped when the base surface is in a predetermined longitudinally offset relation with the supporting surface 72 on the second die member in the direction of die travel to form an outwardly projecting deflectable portion which projects upwardly or outwardly from the container approximately 0.010 to 0.040 inch above the exterior or public surface of the wall around such deflectable portion. The container opening device which is thus formed may be opened by digitally pressing against the deflectable portion to deflect a portion thereof inwardly and thereby strain the fracturable web to initiate fracture of the web and permit inward displacement of a partially separated opening panel.

Figure 6:
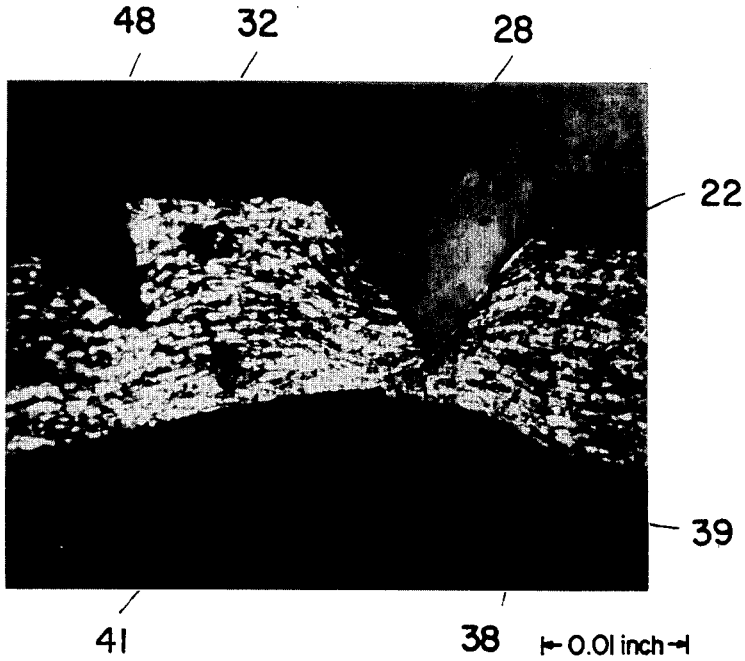
FIG. 6 is an enlarged photomicrograph of a cross section through a portion of a can end of this invention showing the V-shaped indentation and coined line around an opening panel.

FIG. 6 is a photomicrograph through a container end of this invention showing a V-shaped indentation 28 in the public surface of the container end and a generally concave contour of the non-public surface 39 with a fracturable web 38 therebetween. The gain structure reveals that the metal was cut and laterally displaced by the indentor with little distortion of the grain lines. As is typical of most container components of this invention, the component in the photomicrograph also appears to have a roll back of metal in the area of the fracturable web which is believed to be produced when the forming dies are opened and the fracturable web is deformed slightly upon relief of the residual stresses in the metal after the forming process. Such roll back is evidenced by a small indentation or corner 41 in the non-public surface of the component and what appears to be a slip plane or line between such corner and the apex of the V-shaped indentation. This roll back of metal does not appear to adversely affect the functioning of the component or the protective coating on its non-public surface and may contribute to ease of opening by digitally applied pressure without undue loss of ability to resist internal pressure. FIG. 6 shows a coined line 40 in the container component adjacent the weakening line.

Figure 7:
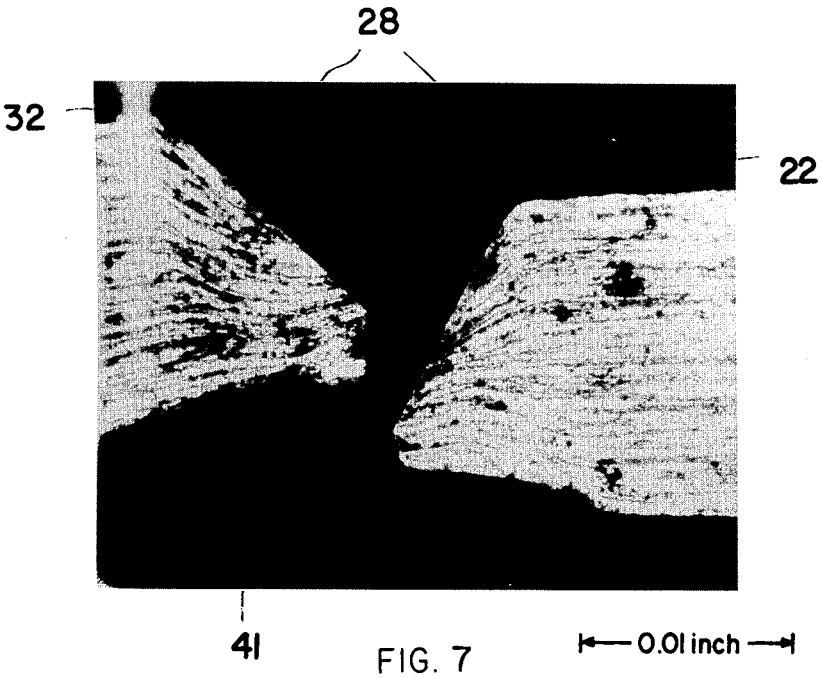
FIG. 7 is an enlarged photomicrograph similar to FIG. 6 showing a fractured web in a container component.

FIG. 7 is a photomicrograph through container component after the web 38 has been fractured by inwardly directed pressure applied against the component in the area of the fracturable web. Although the fracture line appears to be in the form of an angle in the lefthand side of the picture which is on the side of the deflectable portion 32, it is believed that this is merely further evidence of the roll back of metal which partially closed the apex of the V-shaped indentation 28 before fracture of the web. The true fracture line appears to extend from the undersurface of the component to the first corner thereabove on the lefthand side of the photomicrograph.

It is therefore seen that a container component and a method and tools for forming the same are provided which offer improved opening characteristics and improved resistance to damage of the protective coating on the interior surface of the component. A V-shaped indentation is formed in the public surface of the container component providing a fracturable web of metal at the root of the indentation, with an inwardly concave contour on the nonpublic surface of the component underlying the indentation and fracturable web. The tools which form the V-shaped indentation and inwardly concave contour effectively distribute the stresses in the container component and coating thereon to substantially avoid stress cracking of the coating. This invention is particularly well suited for use with container walls or components made of work-hardened aluminum base alloy sheet material in a thickness range of approximately 0.010 to 0.015 inch and which is at least quarter hard, and preferably at least three-quarter hard temper, or is of extra hard temper alloy which has been partially annealed as a result of heating it to cure a protective coating thereon. It is believed that work hardened alloy sheet material is particularly well suited to the practice of this invention because material of the specified hardness is beneficial to conversion of inwardly directed digitally applied pressure into relative displacement of the metal on opposite sides of the fracturable web around the opening panel in the container component. It is further believed that such work hardened alloy is beneficial to the forming of a substantially rigid opening panel in the container wall which also facilitates relative displacement of metal on opposite sides of the fracturable web.

Although a preferred embodiment of a container component and a preferred method and apparatus for forming the same have been illustrated and described, it will be apparent to those skilled in the art that numerous variations could be made therein without departing from the invention.

What is claimed is:

1. In the formation of a sheet metal container component having at least one substantially rigid inwardly displaceable opening panel and an outwardly projecting deflectable portion disposed in integral interconnected relation therewith by a fracturable web, the steps of:

introducing a sheet of metal intermediate a first die member having a first substantially planar metal working surface and a second and angularly disposed substantially planar metal working surface defining with said first surface a corner at the locus of intersection therebetween, said corner having a relatively sharp edge thereon and the outline of the fracturable web to be formed around an opening panel in the sheet metal, and a second die member having a metal supporting and shaping surface thereon generally facing said first die member including a rounded corner generally projecting toward and having the same outline as said corner between said first and second surfaces on said first die member, and with auxiliary die means disposed on the same side of the sheet as said first die member having a metal shaping base surface facing in a generally opposite direction from said metal supporting and shaping surface of said second die member and in laterally spaced relation therewith outwardly of the opening panel to be formed as outlined by the corners on said first and second die members;

lineally displacing said first die member toward said second die member to selectively move said first and second surfaces of said first die member into operative proximity with said rounded shoulder of said second die member, and thereby engage said sheet to laterally displace portions of said sheet as said corner penetrates the sheet to form a V-shaped indentation in the outer surface of the sheet and a rounded impression in the inner surface of the sheet with said fracturable web therebetween, stopping said die member displacement when said corner of said first die member has penetrated the sheet to within a few thousandths of an inch of said metal supporting surface of said second die member, and lineally displacing said auxiliary die means toward said second die member to selectively move said base surface thereof into predetermined longitudinally offset relation with said metal supporting surface of said second die member in the direction of die displacement to form said deflectable portion by the conjoint action of said base surface and said metal supporting surface.

2. A method as set forth in claim 1 wherein a coining rib on the same side of the sheet of metal as said first die, adjacent said corner on said first die and extending substantially parallel thereto is lineally displaced with said first die member to coin said sheet against said metal supporting surface of said second die member along a zone adjacent the fracturable web which is formed in the sheet.

3. A method as set forth in claim 2 wherein said sheet metal is thinned by said coining operation.

4. A method as set forth in claim 1 wherein a sheet of at least three-quarter hard temper aluminum alloy having a protective coating on the surface thereof facing toward said second die member is introduced intermediate said first and second die members which are closed against said sheet.

5. A method as set forth in claim 4 wherein the integrity of the protective coating on the sheet is not destroyed by the action of the die surfaces thereagainst.

6. Apparatus for forming a sheet metal container component having at least one substantially rigid inwardly displaceable opening panel and an outwardly projecting deflectable portion disposed in integral interconnected relation therewith by a fracturable web, comprising:

a first die member having a first substantially planar metal working surface and a second and angularly disposed substantially planar metal working surface defining therewith a corner at the locus of intersection therebetween, said corner having a relatively sharp projecting edge thereon and the outline of the fracturable web to be formed around an opening panel in a container component, a second die member having metal supporting surfaces thereon generally facing said first die member including a rounded corner generally projecting toward and having the same outline as said corner between said first and second surfaces on said first die member, and auxiliary die means having a metal shaping base surface facing in a generally opposite direction from said metal supporting surfaces of said second die member and disposed in laterally spaced relation therewith outwardly of the opening panel to be formed as outlined by the corners on said first and second die members, said first die member and said auxiliary die means being lineally displaceable relative to said second die member with said first and second surfaces of said first die member in generally opposed relation with said rounded corner of said second die member, whereby displacement of said die members and said auxiliary die means against a sheet of metal positioned therebetween to a closed die position in which said corner of said first die member is disposed within a few thousandths of an inch of said metal supporting surface of said second die member and said base surface of said auxiliary die means is in longitudinally offset relation with said metal supporting surface of said die member in the direction of die displacement will laterally displace portions of said sheet within the locus of displacement thereof through the conjoint action of said first and second surfaces of said first die member and said rounded corner of said second die member to form a V-shaped indentation in the outer surface of the sheet and a rounded impression in the inner surface of the sheet with said fracturable web therebetween, and will form said deflectable portion by the conjoint action of said metal supporting surface of said second die and said base surface of said auxiliary die means.

7. Apparatus as set forth in claim 6 which further includes a coining rib adjacent said corner on said first die member and extending substantially parallel thereto and which is adapted to be lineally displaced with said first die member to coin said sheet against said metal supporting surface of said second die member.

8. Apparatus as set forth in claim 6 in which said first and second surfaces of said first die member have an included angle therebetween formed by the solid portion of the die of approximately 75°.

9. Apparatus as set forth in claim 6 in which said rounded corner has a radius of curvature of approximately 0.020 inch.

* * * * *